US007699655B2

(12) United States Patent
Wang et al.

(10) Patent No.: US 7,699,655 B2
(45) Date of Patent: Apr. 20, 2010

(54) ELECTRICAL CONNECTOR HAVING A SHIELDING SHELL

(75) Inventors: Hong-Liang Wang, Kunshan (CN); Ming Zhang, Kunshan (CN)

(73) Assignee: Hon Hai Precision Inc. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/317,825

(22) Filed: Dec. 29, 2008

(65) Prior Publication Data

US 2009/0170372 A1 Jul. 2, 2009

(30) Foreign Application Priority Data

Dec. 29, 2007 (CN) ..... 2007 2 0129820 U

(51) Int. Cl.
*H01R 13/648* (2006.01)

(52) U.S. Cl. ..... 439/607.33; 439/607.47; 439/607.56

(58) Field of Classification Search ..... 439/607.13, 439/607.14, 607, 607.17, 607.22, 607.31, 439/607.32, 607.33, 607.35, 607.36, 607.37, 439/607.39, 607.4, 607.41, 607.47, 607.48, 439/607.49, 607.54, 607.55, 607.56, 607.57
See application file for complete search history.

(56) References Cited

U.S. PATENT DOCUMENTS

| | | | | |
|---|---|---|---|---|
| 6,749,463 | B1 | 6/2004 | Fan | |
| 6,875,055 | B2 * | 4/2005 | Chu et al. | 439/607.24 |
| 6,954,363 | B2 | 10/2005 | Fan | |
| 7,134,912 | B2 | 11/2006 | Kamata et al. | |
| 2006/0063432 | A1 * | 3/2006 | Chen | 439/607 |

* cited by examiner

*Primary Examiner*—Ross N Gushi
(74) *Attorney, Agent, or Firm*—Andrew C. Cheng; Wei Te Chung; Ming Chieh Chang

(57) ABSTRACT

An electrical connector includes an insulative housing (2), a plurality of terminals (3) received in the insulative housing (2) and a shielding shell (4) covering the insulative housing. The insulative housing (2) includes a mating opening (24) extending along a longitudinal direction and a pair of grooves (231) extending with an angle to the mating opening and opening to an exterior. The shielding shell is provided with two shielding shell (41), (42) attached to an outer periphery of the insulative housing (2), which their ends are received and retained in the grooves (231).

18 Claims, 4 Drawing Sheets

ELECTRICAL CONNECTOR HAVING A SHIELDING SHELL

BACKGROUND OF THE INVENTION

1. Field of the Invention

The present invention relates to electrical connectors, especially to an electrical connector having a shielding shell.

2. Description of the Related Art

U.S. Pat. No. 6,954,363 issued to Fan et al. on Oct. 11, 2005, discloses a conventional connector mounted on a Printed Circuit Board (PCB) for engaging with a mating connector. The conventional connector includes a housing, a plurality of contacts received in the housing and a pair of shells covering the housing. The housing includes a pair of longitudinal side walls and a pair of end walls connecting with ends of the longitudinal side wall. Two flanges extend outwards from ends of the end wall along a longitudinal direction of the housing with a slot between of the end wall and the flange. Each of the shells includes a blade portion attached on outer of the side walls, and a pair of side portion curving from opposite ends of the blade portion and attached on outers of the end walls of the housing. The side portions of the shells are provided with legs, which are used to be inserted into and retained in the slots of the housing so as fitly attach the shell to the housing.

However, the length of the connector along the longitudinal direction will increase for the two flange of the housing, and the mounting area of the connector on the PCB will also increase.

Therefore, an improved electrical connector is desired to overcome the disadvantages of the relate arts.

SUMMARY OF THE INVENTION

An object of the present invention is to provide an electrical connector having a shielding shell with smaller size.

In order to achieve above-mentioned object, an electrical connector in accordance with a preferred embodiment of the present invention mounted on the PCB for engaging with a mating connector includes an insulative housing, a plurality of terminals received in the insulative housing and a shielding shell covering the insulative housing. The insulative housing includes a mating opening extending along a longitudinal direction and a pair of grooves extending with an angle to the mating opening and opening to an exterior. The shielding shell is provided with two shielding shells attached to an outer periphery of the insulative housing, which their ends are received and retained in the grooves, so as fitly attach the shielding shell to the insulative housing with a smaller size.

Other objects, advantages and novel features of the invention will become more apparent from the following detailed description of the present embodiment when taken in conjunction with the accompanying drawings.

DETAILED DESCRIPTION OF THE INVENTION

Figure 1:
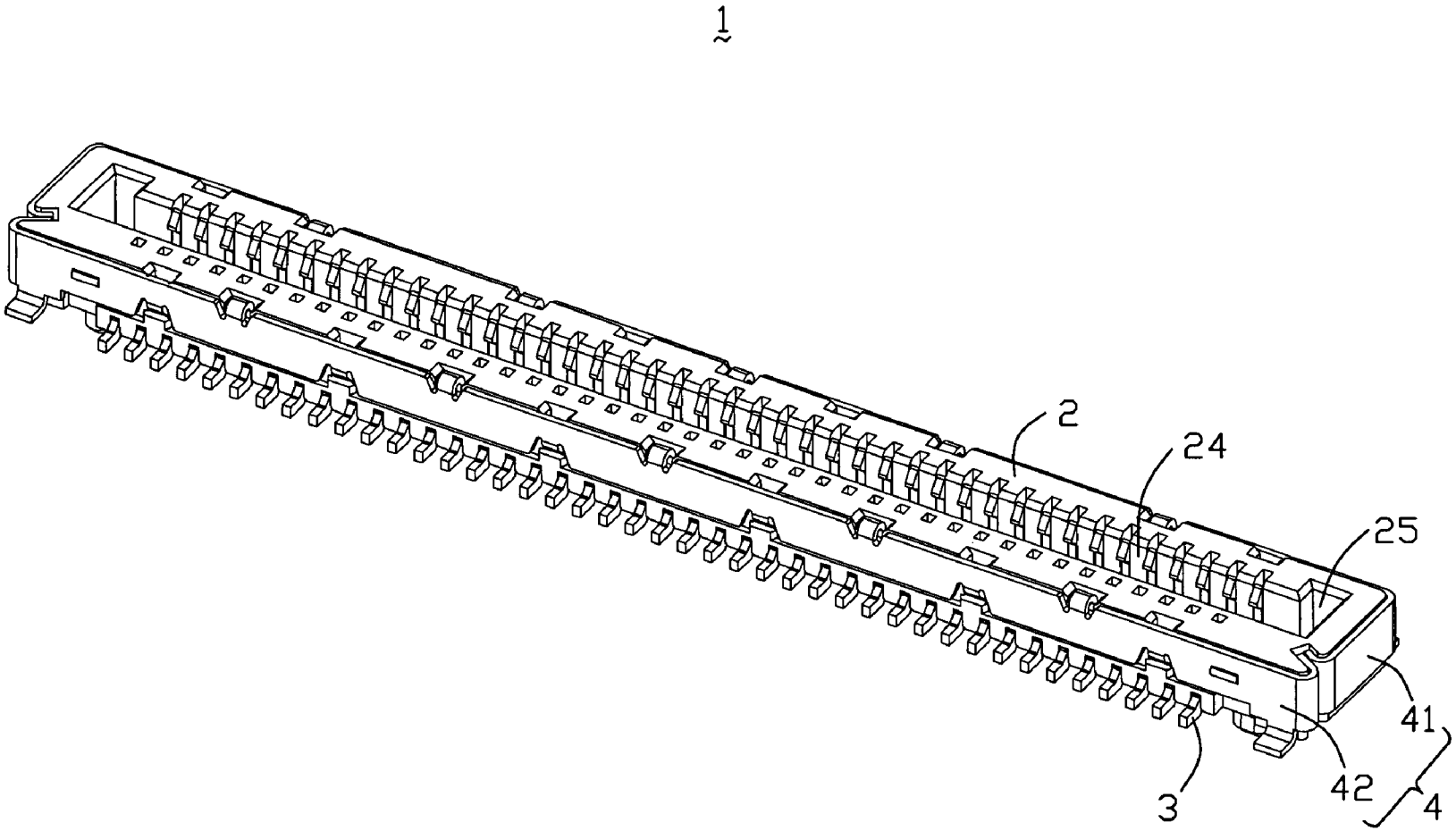
FIG. 1 is a perspective view of an electrical connector in accordance with the preferred embodiment of the present invention.

Reference will now be made to the drawing figures to describe the preferred embodiment of the present invention in detail.

Referring to FIG. 1, an electrical connector 1 mounted on a PCB (Printed Circuit Board) (not shown) for engaging with a mating connector (not shown) in accordance with the preferred embodiment of the present invention, defines a longitudinal insulative housing 2, a plurality of terminals 3 received in the insulative housing 2 and a shielding shell 4 covering the insulative housing.

Figure 2:
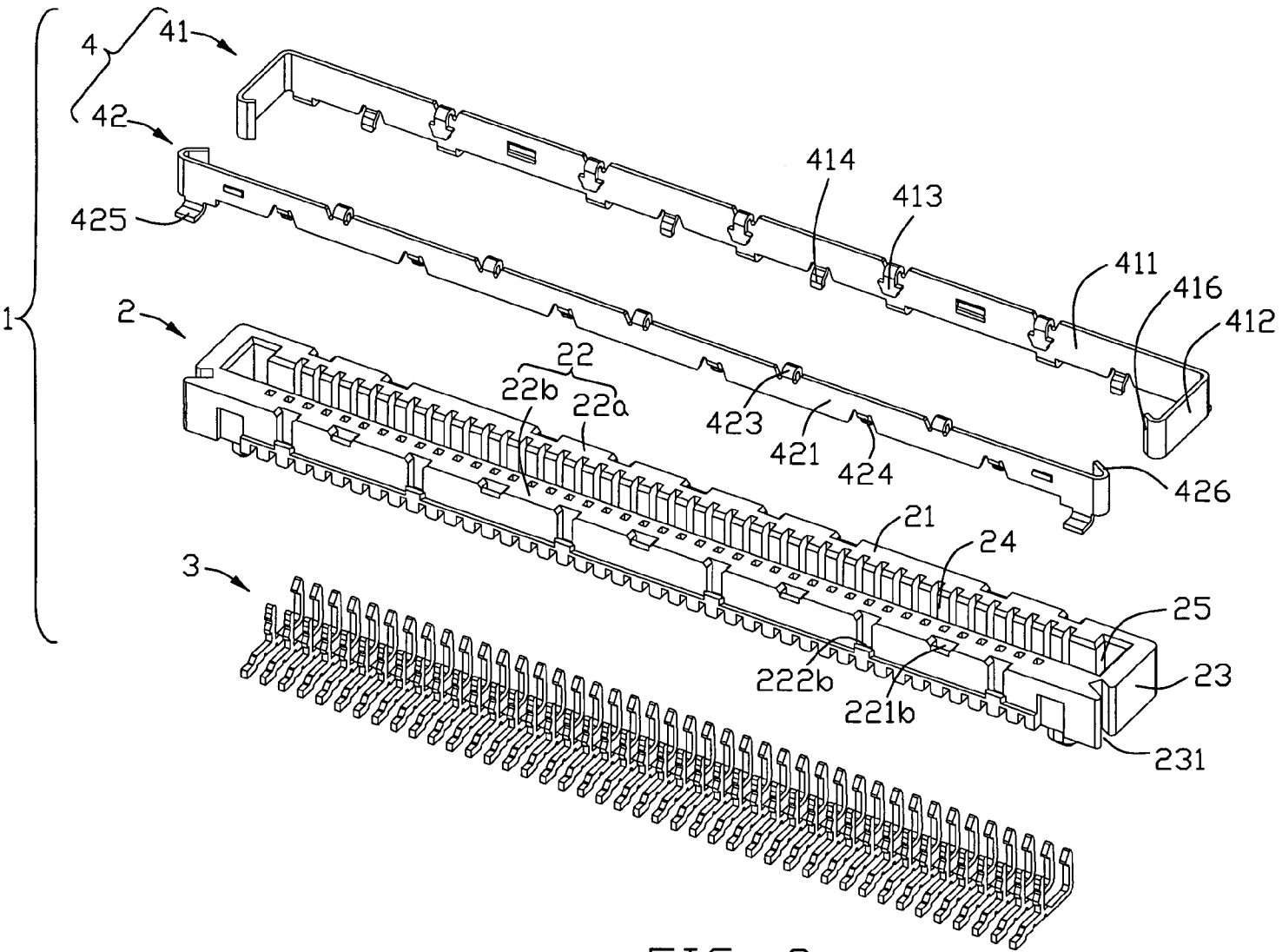
FIG. 2 is an exploded perspective view of the electrical connector of FIG. 1 viewed from a mating surface of the electrical connector.
Figure 4:
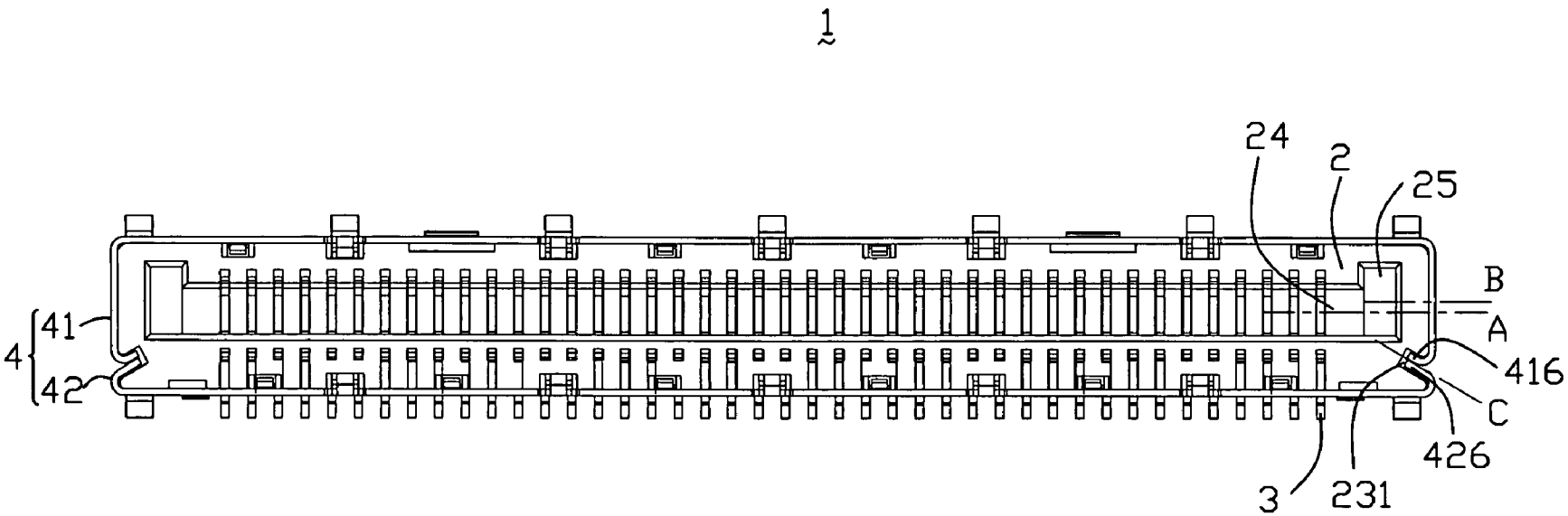
FIG. 4 is a top plan view of the electrical connector of FIG. 1.

Referring to FIG. 2 and FIG. 4, the insulative housing 2 has a longitudinal mating surface 21 on top thereof and a wall portion. The wall portion includes a pair of side walls 22 extending along a longitudinal direction thereof and a pair of end walls 23 connecting with two ends of the side walls. The insulative housing 2 has a mating opening 24 between the side walls for receiving the mating connector and a pair of guiding holes 25 communicating with the mating opening 24 at the two opposite ends of the housing. The guiding holes 25 are aligned with one inner face of the side wall 22*b*, while recess further at another side than the inner face of the side wall 22*a* so that the guiding holes are larger than the mating opening in a traverse direction. In other word, the mating opening 24 and the guiding holes 25 have a central plane A and B respectively, the two planes being offset for anti-mismating of the mating connector.

A groove or retention slit 231 is provided at each corner of the side wall 22*b* with the end walls 23. The grooves 231 communicate with an exterior through the periphery surface and open upwards and downwards. As shown in FIG. 4, the grooves 231 and the central planes B of the guiding holes 25 are at two sides of the central plane A of the mating opening 24. The groove 231 defines a central plane C, which forms an angle with the central plane A. The groove 231 is on the side wall 22*b* not the side wall 22*a* in the preferred embodiment since the side wall 22*b* adjacent to the guiding holes is thicker than the side wall 22*a*.

The shielding shell 4 includes a first shielding shell 41 and a second shielding shell 42. The first shielding shell 41 defines a longitudinal first body portion 411 covering an outside of one side wall 22*a* and an extending portion 412 perpendicular bending from each end of the first body portion 411 used for covering an outside of the two end walls 23. The first body portion 411 defines a plurality of first retaining portions 413 bending inwards from an top edge thereof to be inserted into and retained in corresponding receiving holes 221*a* (shown in FIG. 3), a plurality of secured tails 414 extending from a bottom edge thereof to be inserted in and retained in corresponding receiving holes 222*a* at the outer face of side wall 22*a* (shown in FIG. 3) and a plurality of first soldering tails 415 extending outwards for being soldered on the PCB, when the first shielding shell 41 is assembled on the housing. A first bending portion 416 bends inwards with a predetermined angle for receiving in groove 231.

The second shielding shell 42, which is similar to the first shielding shell 41, includes a longitudinal second body portion 421 covering an outside of one side wall 22*b*. The second body portion 421 also has a plurality of second retaining portions 423 secured in the retaining holes 221*b*, and a plurality of second secured tails 424 received in the receiving holes 222*b*. A pair of second soldering tails 425 bend outwards from the bottom edges adjacent to two opposite ends thereof. A pair of second bending portions 426 bend inwards with a predetermined angle to receive in the grooves 231 for engaging with the first bending portion 416.

Figure 3:
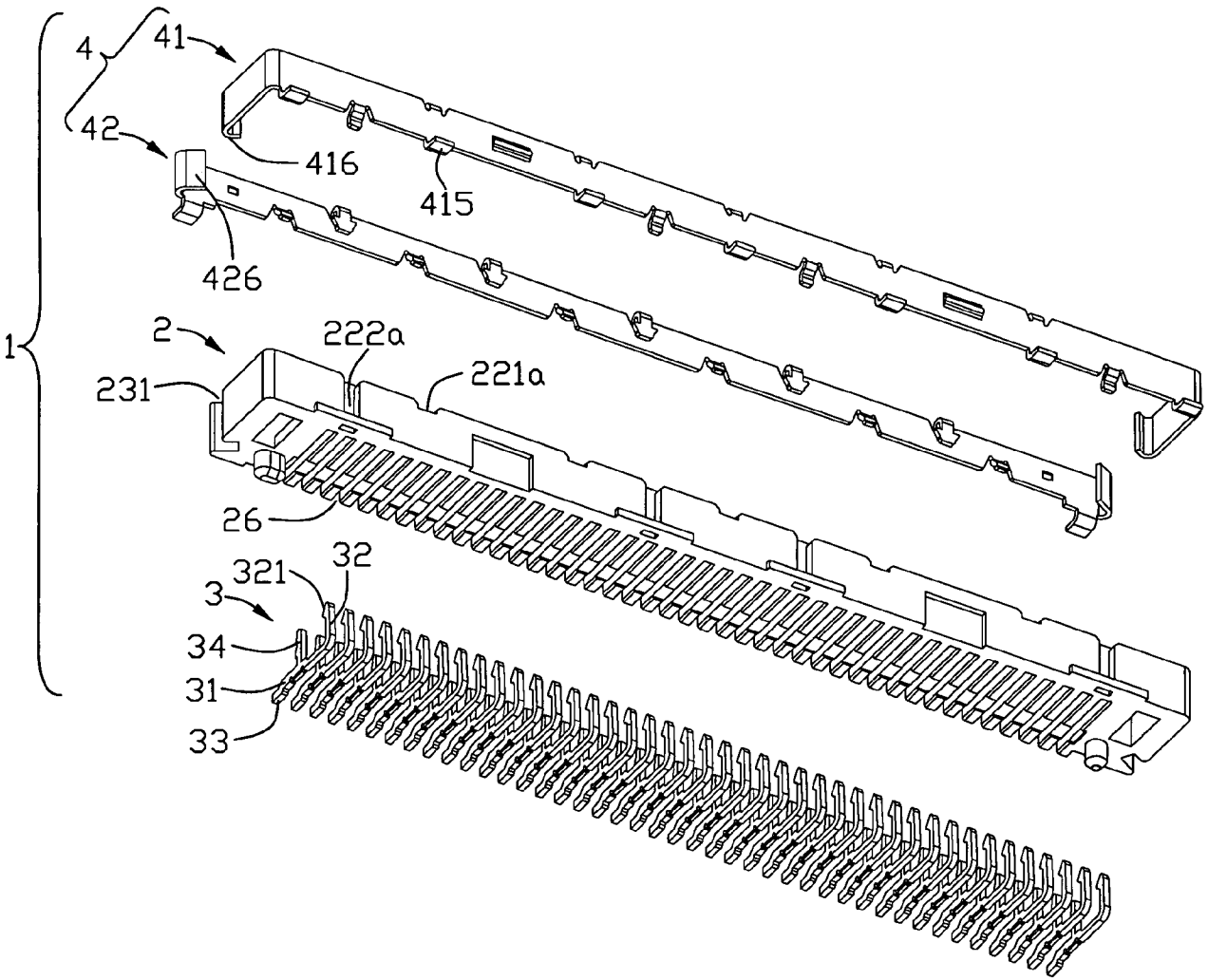
FIG. 3 is an exploded, perspective view of the electrical connector of FIG. 1 viewed from a mounting surface of the electrical connector.

Referring to FIG. 3, the insulative housing 2 is provided with a plurality of terminal receiving passageways 26. Each of the terminals 3 has a base portion 31, a contacting arm 32 extending towards the mating opening 24 from one end of the base portion 31 and a soldering portion 33 extending outwards from the other end of the base portion. The contacting arm 32 has an engaging portion 321 protruding towards the mating opening 24 for electrically connecting with the mating connector. The base portion 31 defines a retaining arm 34 extending upwards from the middle portion of the base portion for being secured in the insulative housing 2.

Referring to FIG. 3 and FIG. 4, the first bending portions 416 and the second bending portions 426 at the same end is secured in one groove 231 and engage with each other to complete electrical connection. The two bending portions interfere with each other and separately interfere with inside faces of the grooves so that the two bending portions are secured in the grooves 231.

However, the disclosure is illustrative only, changes may be made in detail, especially in matter of shape, size, and arrangement of parts within the principles of the invention.

For example, the shielding shell 4 also is manufactured from one piece of metal board via pressing and bending, and the both ends of the shielding shell have bending portions received in the grooves.

What is claimed is:

1. An electrical connector comprising:

an insulative housing comprising a pair of side walls and a pair of end walls connecting with the side walls and a mating opening defined between the side walls;

a groove defined at each corner of one of said side walls with the end walls;

a plurality of terminals, each the terminal defining a retaining arm secured in the insulative housing, an engaging portion protruding towards the mating opening and a soldering portion extending outwards from the retaining portion; and a shielding shell covering the insulative housing, comprising a first shielding shell and a second shielding shell, the two shielding shells comprising a pair of bending portions at opposite ends thereof respectively;

wherein the bending portions of the two shielding shells at the same end of the shell are commonly received and retained in one corresponding groove.

2. The electrical connector as described in claim 1, wherein the grooves extend with an angle to the mating opening and communicate with an exterior surface.

3. The electrical connector as described in claim 2, wherein the bending portions in one groove engage with each other, and each bending portion interfere with a corresponding inner face of the groove.

4. The electrical connector as described in claim 2, wherein the first shielding shell and the second shell comprise a plurality of retaining portions retained in the insulative housing and a plurality of secured tails extending outwards for soldering.

5. The electrical connector as described in claim 2, wherein the insulative housing comprises a pair of guiding holes communicating with the mating opening, one of the side walls adjacent to the guiding holes is thicker than the other side wall.

6. The electrical connector as described in claim 1, wherein the grooves open upwards and downwards.

7. The electrical connector as described in claim 1, wherein the first shielding shell comprises a longitudinal first body portion and a pair of extending portions bending from ends of the first body portion and covering an outside of end walls, said bending portions bend inwards from ends of the extending portions with an predetermined angle for receiving in the grooves.

8. The electrical connector as described in claim 1, wherein the insulative housing comprises a pair of guiding holes communicating with the mating opening, and the guiding holes are larger than the mating opening in a traverse direction.

9. An electrical connector comprising:

an insulative housing having a mating opening extending along a longitudinal direction and a pair of grooves extending with an angle to the mating opening and opening to an exterior;

a plurality of terminals received in the insulative housing; and a metallic shell shrouding the insulative housing and including first and second parts each at a free end having a bending portion hooked at a corner of the insulative housing with an acute angle relative to a remaining body portion thereof.

10. The electrical connector as described in claim 9, wherein the bending portions of said first and second parts are secured in a same one of said pair of grooves.

11. The electrical connector as claimed in claim 10, wherein said same one groove extends along a diagonal direction at said corner.

12. An electrical connector comprising:

an insulative housing defining a mating port exposed to an exterior in a first direction and surrounded by a circumferential wall;

a plurality of contacts disposed in the housing with contacting sections exposed in the mating port;

a retention slit formed in the circumferential wall and extending inwardly in an oblique direction from an exterior surface of the circumferential wall; and at least one metallic shell covering at least a portion of said circumferential wall; wherein said shell defines an engagement tab received in said retention slit to hold said shell in position with regard to the housing;

wherein another metallic shell covers other portions of the circumferential wall while with another engagement tab received in said retention slit.

13. The electrical connector as claimed in claim 12, wherein said retention slit is essentially located at a corner of the circumferential wall.

14. The electrical connector as claimed in claim 13, wherein said retention slit extends diagonally at said corner.

15. The electrical connector as claimed in claim 12, wherein said another shell is longer than said shell.

16. The electrical connector as claimed in claim 15, wherein the longer shell has the corresponding shorter engagement tab than the shorter shell.

17. The electrical connector as claimed in claim 12, wherein said circumferential wall defines two longitudinal exterior surfaces and two transverse exterior surfaces perpendicular to each other, and said retention slit is oblique to both said longitudinal exterior surfaces and said transverse surfaces.

18. The electrical connector as claimed in claim 12, wherein said engagement tab unitarily extends from the corresponding shell with an acute angle.

* * * * *